US011506998B2

(12) United States Patent
Lee et al.

(10) Patent No.: US 11,506,998 B2
(45) Date of Patent: Nov. 22, 2022

(54) TRANSFER DEVICE HAVING MEANDERING PREVENTION MEMBERS FOR AN IMAGE FORMING APPARATUS

(71) Applicant: HEWLETT-PACKARD DEVELOPMENT COMPANY, L.P., Spring, TX (US)

(72) Inventors: Jin-ho Lee, Pangyo (KR); Ho-gun You, Pangyo (KR); Jun-ho Lee, Seoul (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/136,501

(22) Filed: Dec. 29, 2020

(65) Prior Publication Data

US 2021/0116845 A1 Apr. 22, 2021

Related U.S. Application Data

(63) Continuation of application No. 16/312,932, filed as application No. PCT/KR2017/002486 on Mar. 8, 2017, now Pat. No. 10,908,536.

(30) Foreign Application Priority Data

Jun. 28, 2016 (KR) ..... 10-2016-0080898

(51) Int. Cl.

| | |
|---|---|
| ***G03G 15/16*** | (2006.01) |
| ***G03G 15/20*** | (2006.01) |
| *G03G 15/00* | (2006.01) |

(52) U.S. Cl.

CPC ..... *G03G 15/161* (2013.01); *G03G 15/16* (2013.01); *G03G 15/20* (2013.01); *G03G 15/00* (2013.01)

(58) Field of Classification Search

CPC ..... G03G 15/161; G03G 15/1615

See application file for complete search history.

(56) References Cited

U.S. PATENT DOCUMENTS

| | | | |
|---|---|---|---|
| 8,689,967 B2 | 4/2014 | Kitamura | |
| 10,386,756 B2 * | 8/2019 | Okamoto | G03G 15/755 |

(Continued)

FOREIGN PATENT DOCUMENTS

| | | |
|---|---|---|
| JP | 2009-199055 | 9/2009 |
| JP | 2012-32437 | 2/2012 |

(Continued)

*Primary Examiner* — Walter L Lindsay, Jr.
*Assistant Examiner* — Andrew V Do
(74) *Attorney, Agent, or Firm* — Staas & Halsey LLP

(57) ABSTRACT

A transfer device for an image forming apparatus includes a frame, a driving roller, a backup roller, and a transfer belt to travel between the driving roller and the backup roller. The transfer device further include meandering prevention members to rotate independently of the backup roller, the meandering prevention members including a first meandering prevention member located between a first end portion of the backup roller and the frame, and a second meandering prevention member located between a second end portion of the backup roller and the frame. When the transfer belt meanders and contacts one of the first and second meandering prevention members, the one of the first and second meandering prevention members is to be rotatably driven to increase a tension of the transfer belt.

20 Claims, 16 Drawing Sheets

(56) References Cited

U.S. PATENT DOCUMENTS

| | | | |
|---|---|---|---|
| 2009/0016772 | A1 | 1/2009 | Adachi |
| 2009/0074492 | A1 | 3/2009 | Ito |
| 2014/0054139 | A1 | 2/2014 | Ogata |
| 2014/0144759 | A1 | 5/2014 | Kawanami |

FOREIGN PATENT DOCUMENTS

| | | |
|---|---|---|
| JP | 2015-191075 | 11/2015 |
| KR | 10-2009-0131492 | 12/2009 |
| KR | 10-1357679 | 2/2014 |

* cited by examiner

【Figure 1】
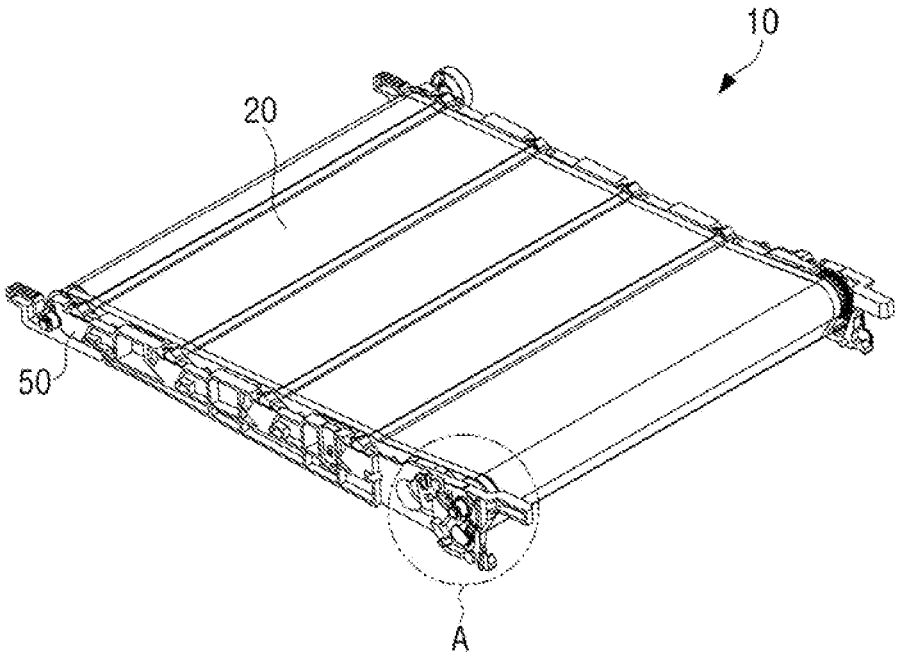

【Figure 2】
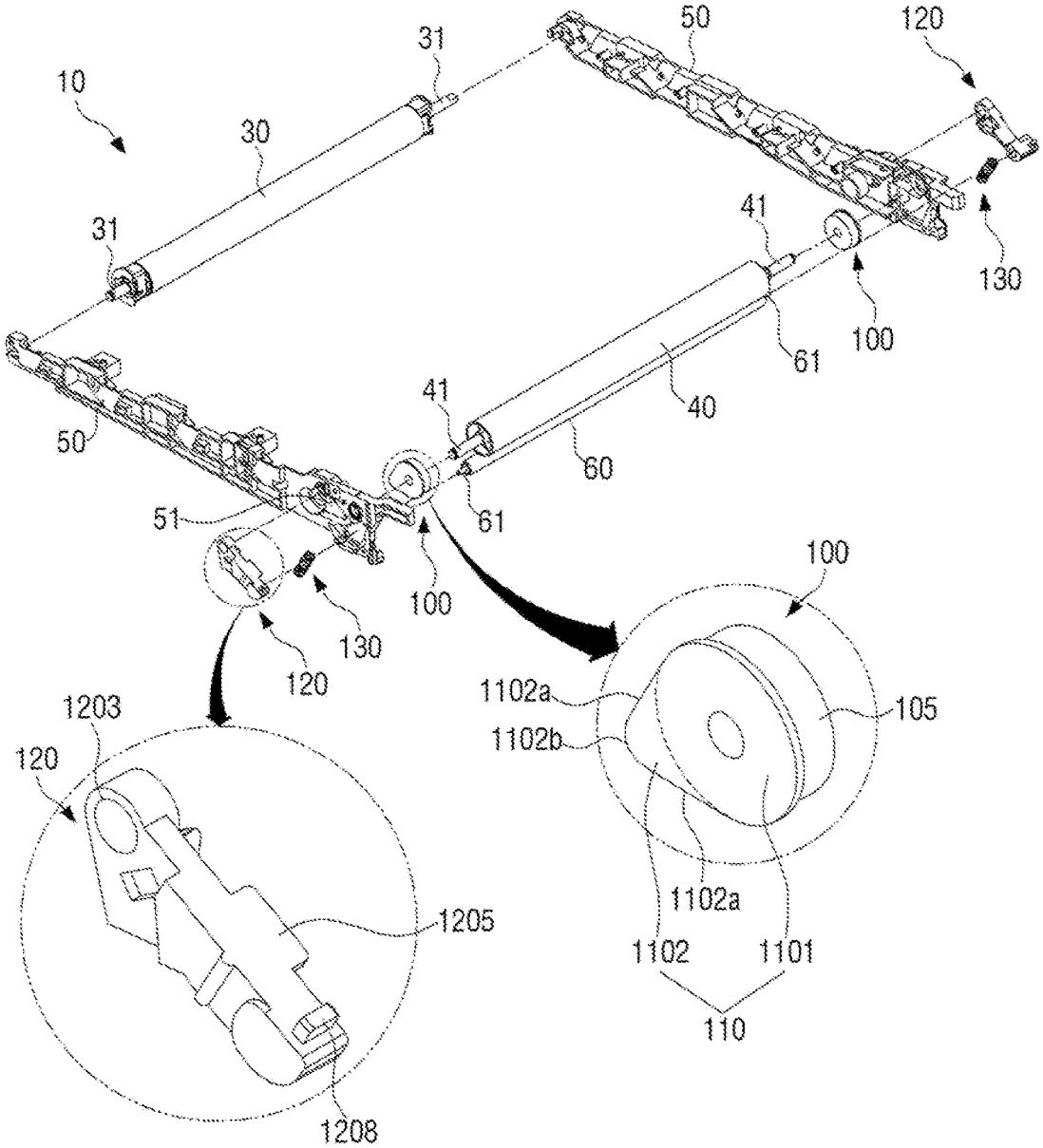

【Figure 3】
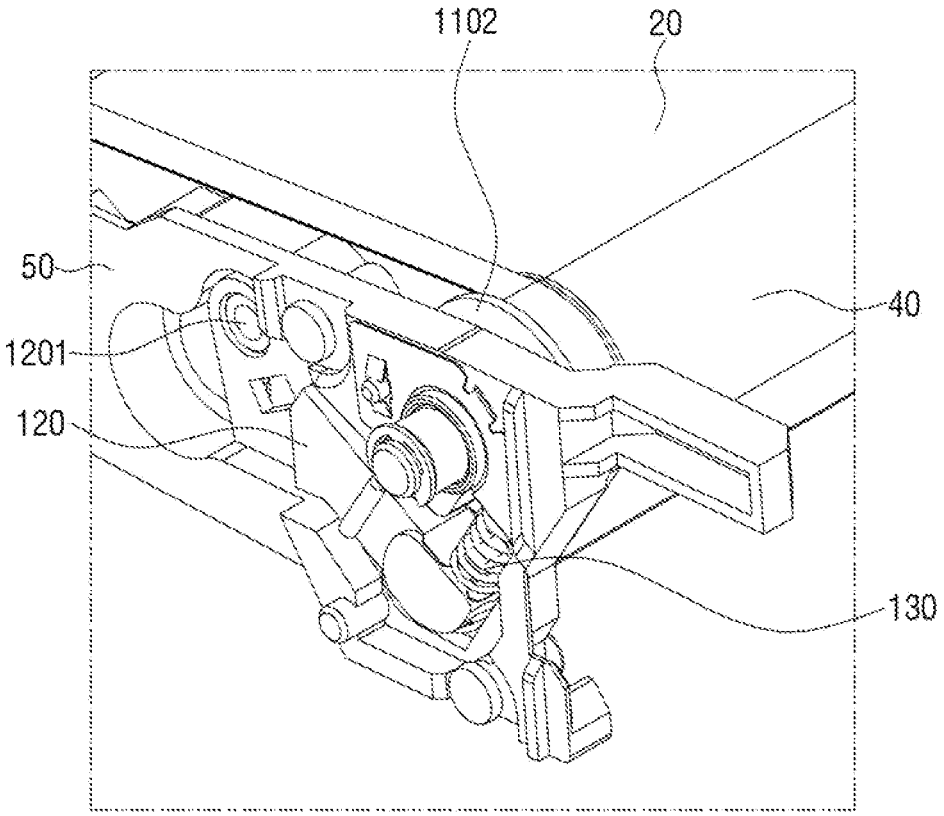

【Figure 4a】
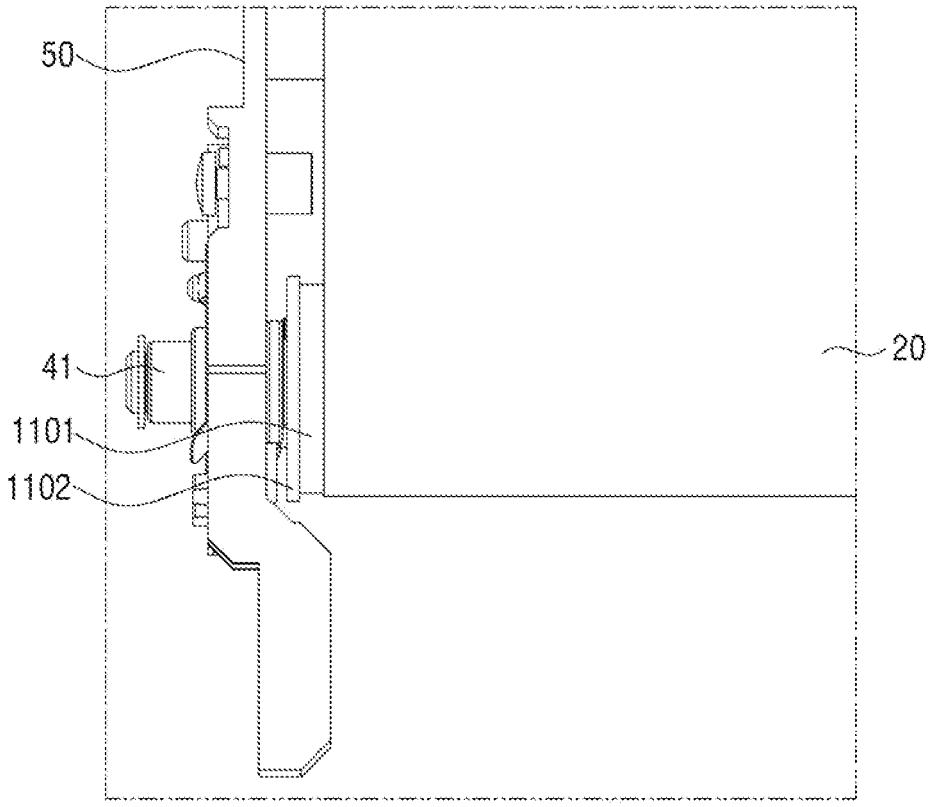

【Figure 4b】
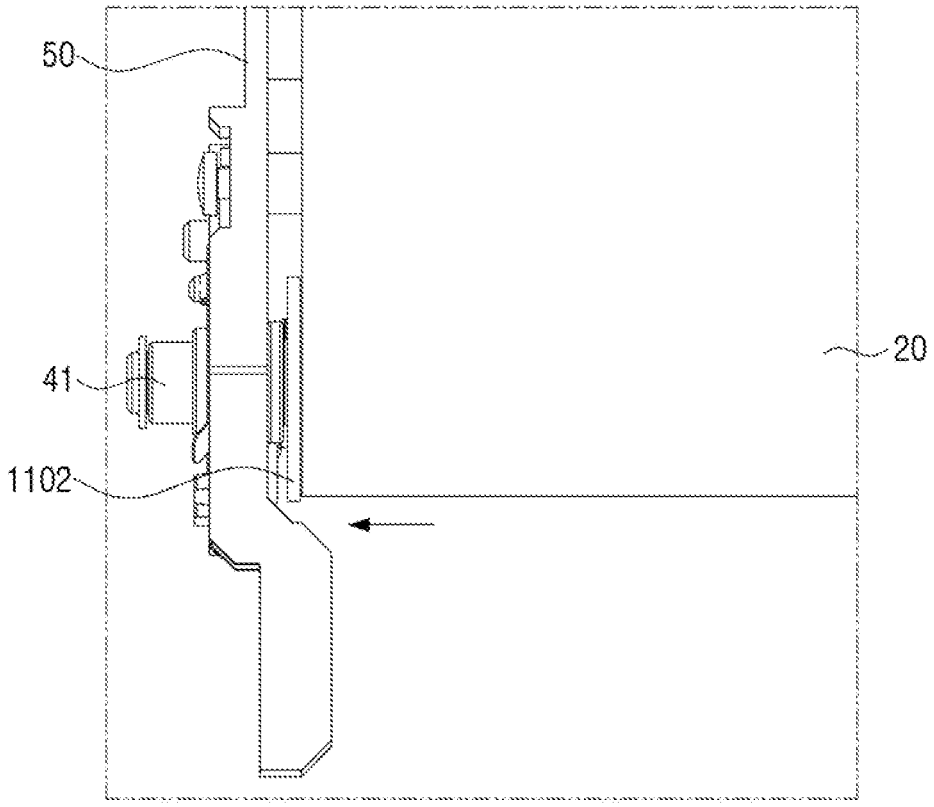

【Figure 5a】
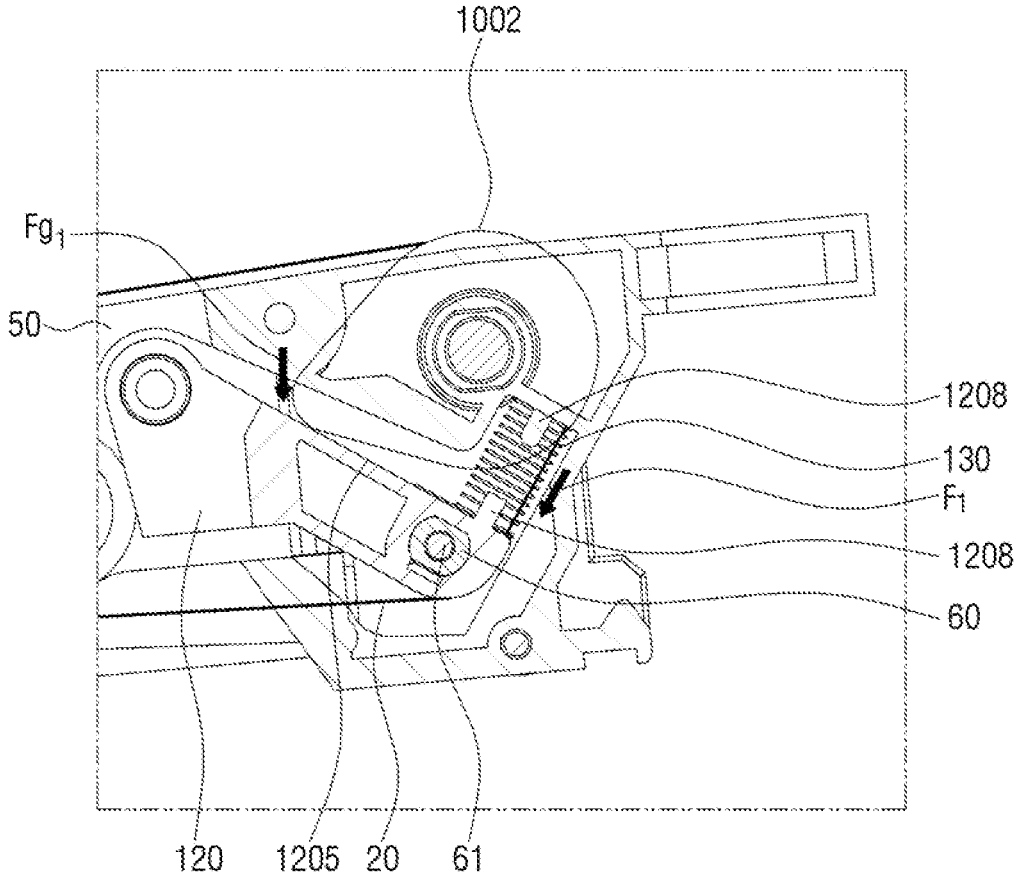
【Figure 5b】
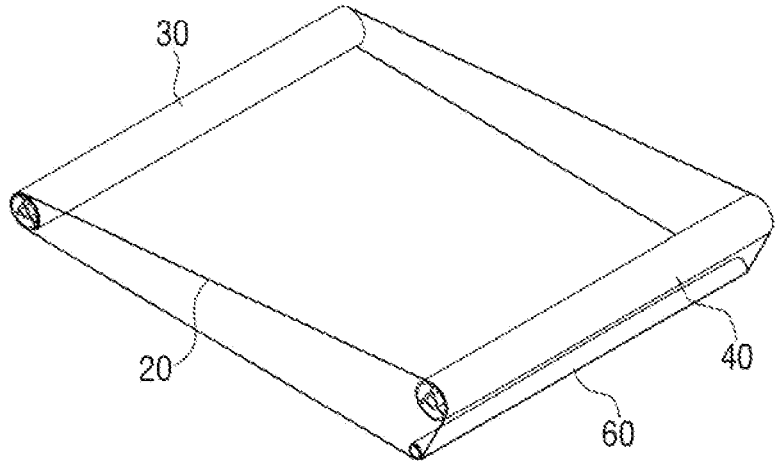

【Figure 6a】
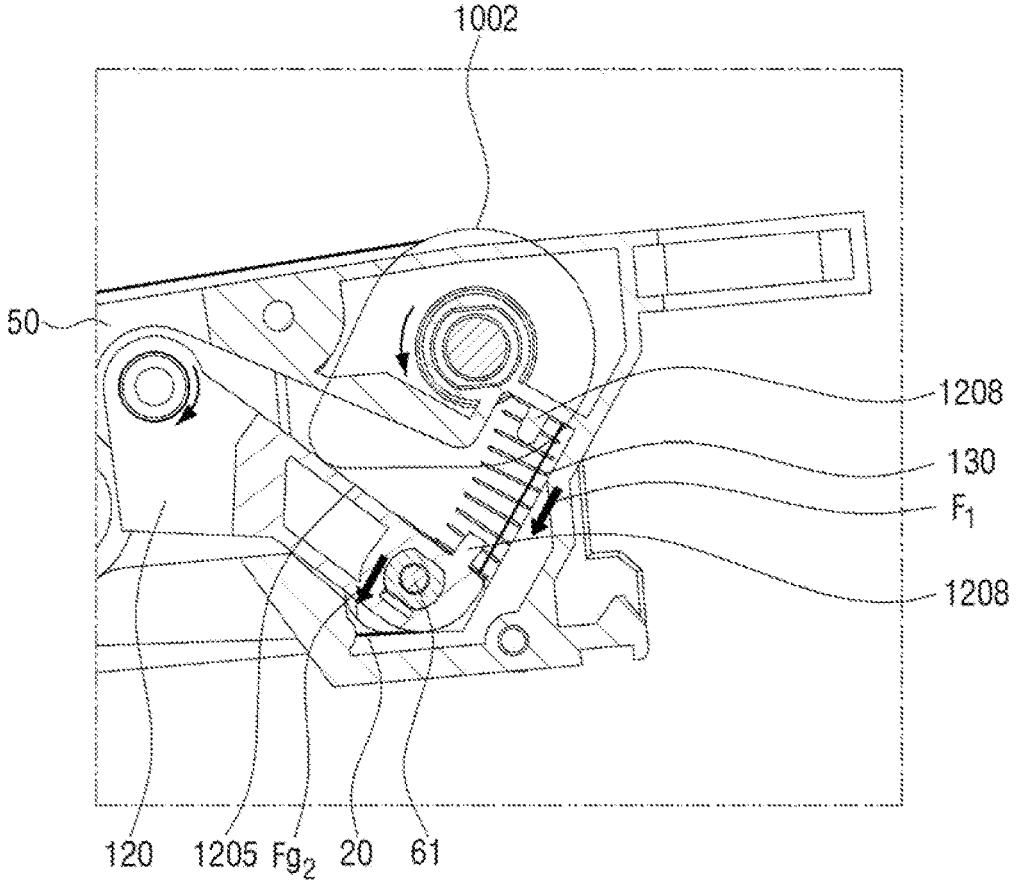
【Figure 6b】
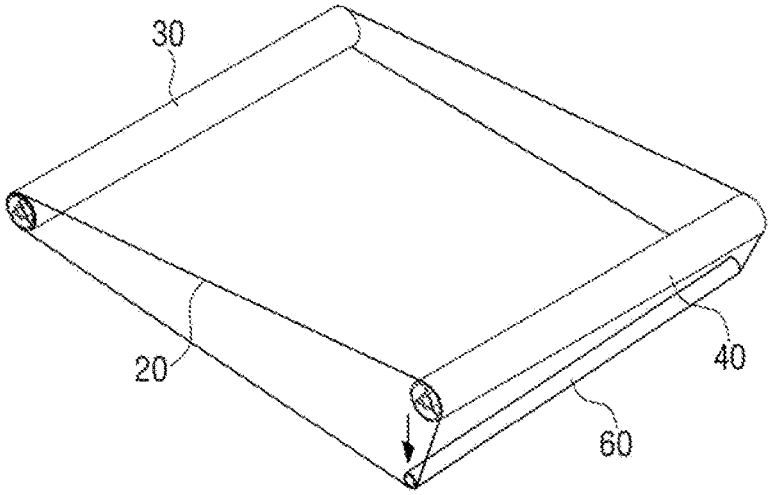

【Figure 7a】
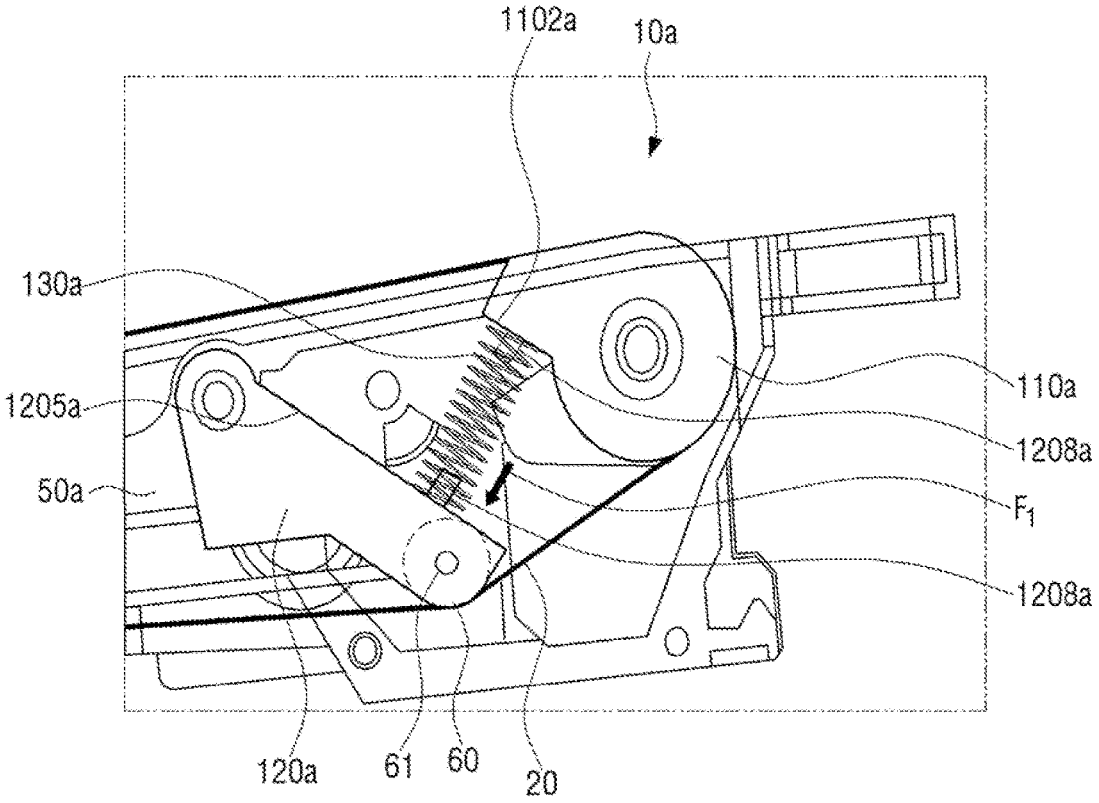
【Figure 7b】
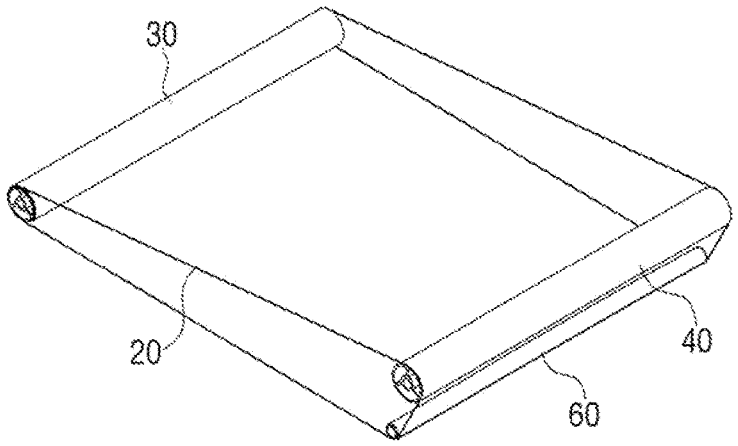

【Figure 8a】
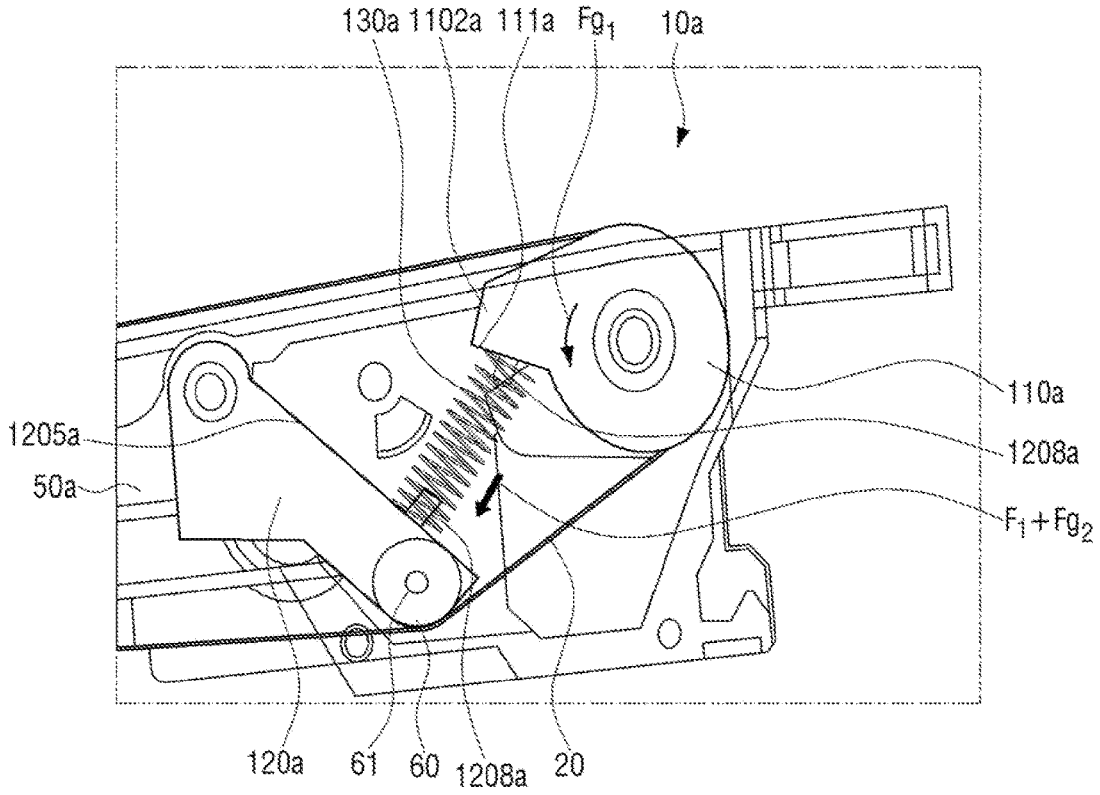
【Figure 8b】
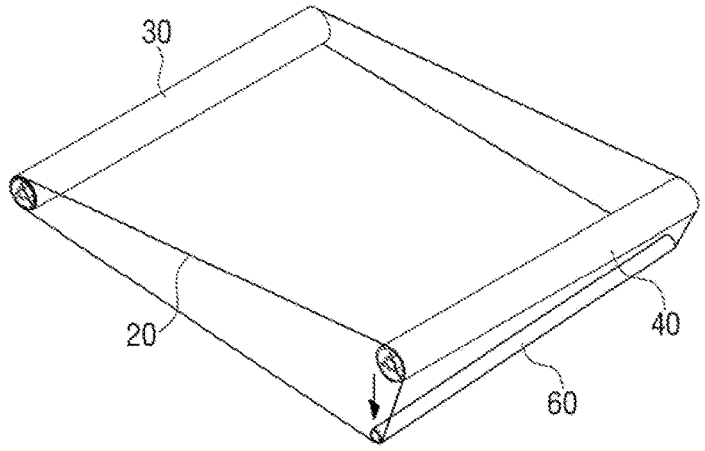

【Figure 9a】
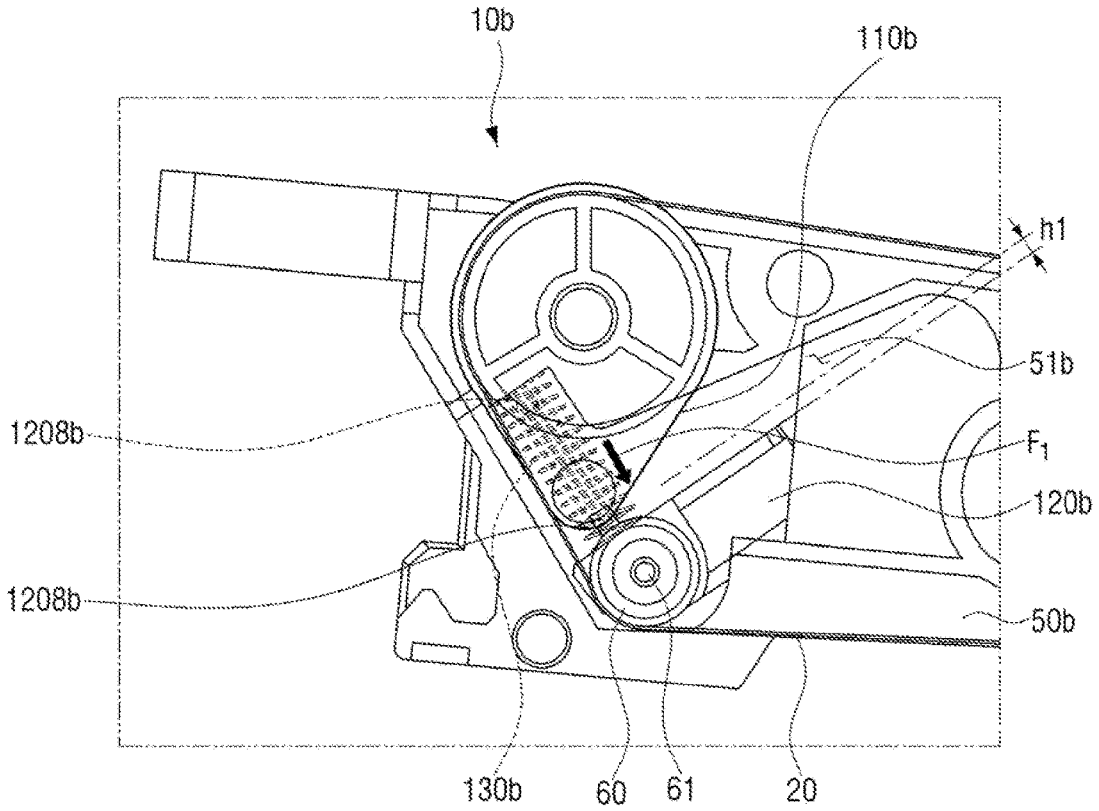
【Figure 9b】
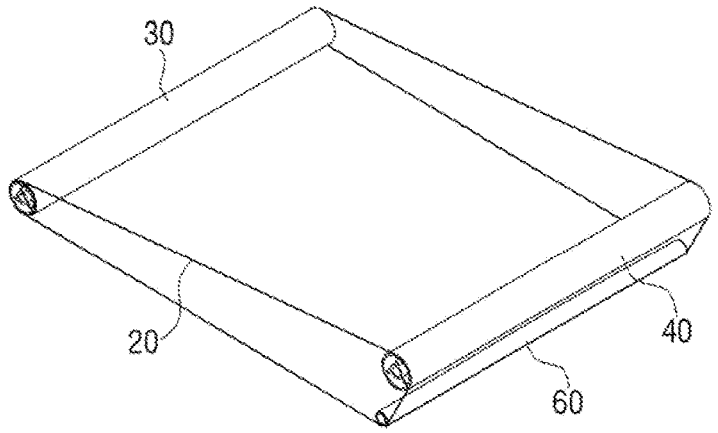

【Figure 10a】
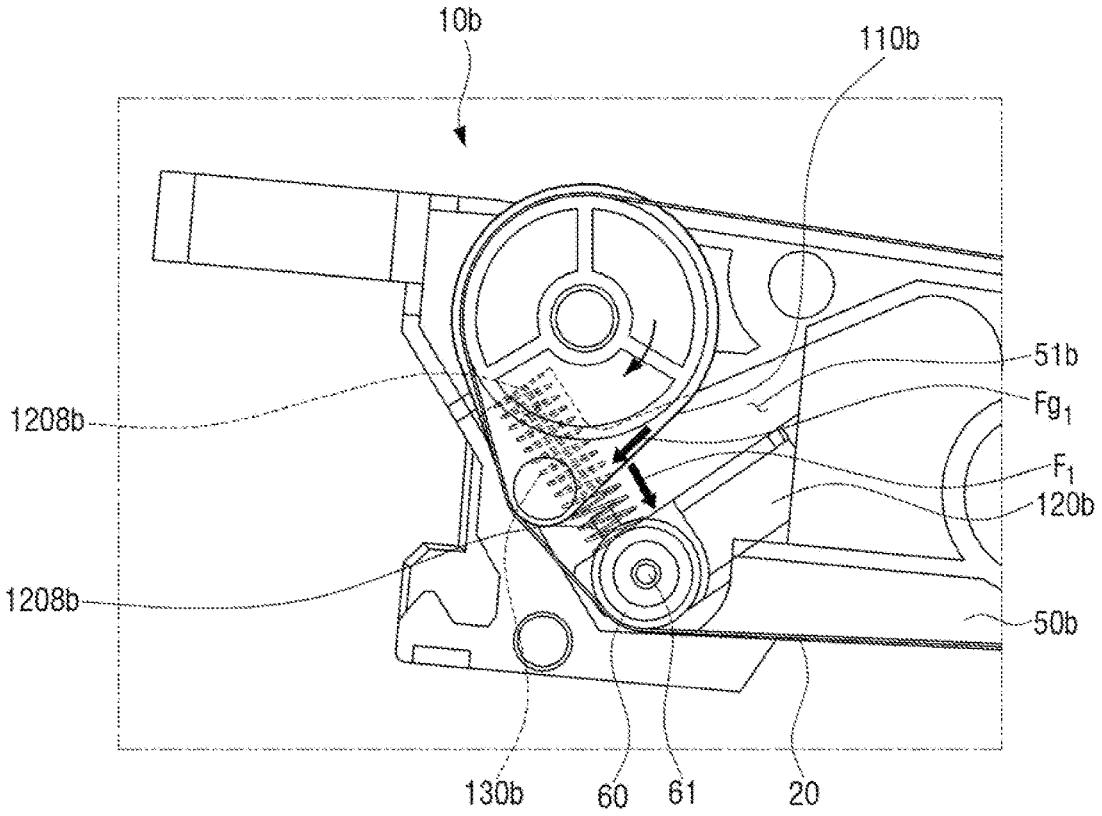
【Figure 10b】
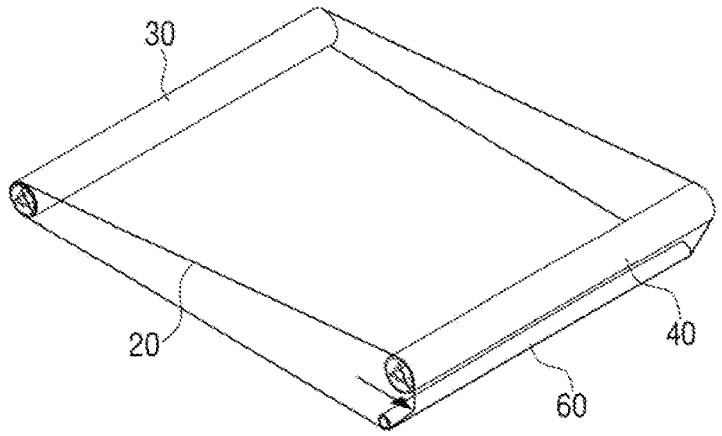

【Figure 11】
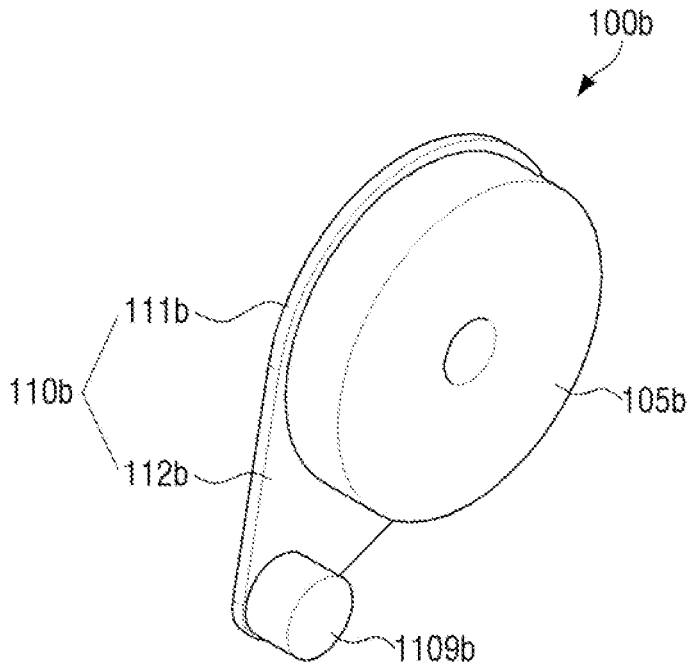

【Figure 12a】
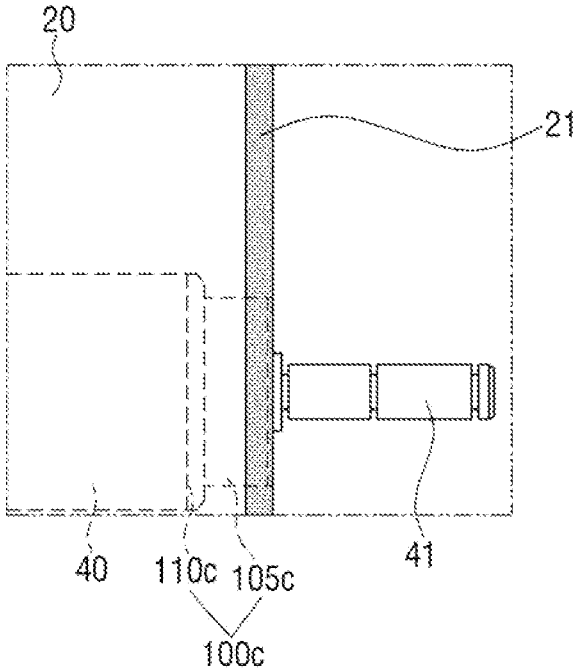
【Figure 12b】
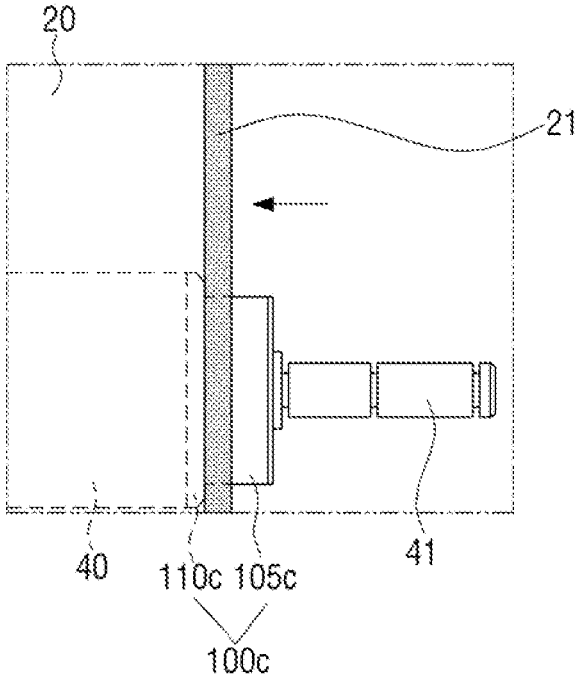

【Figure 13a】
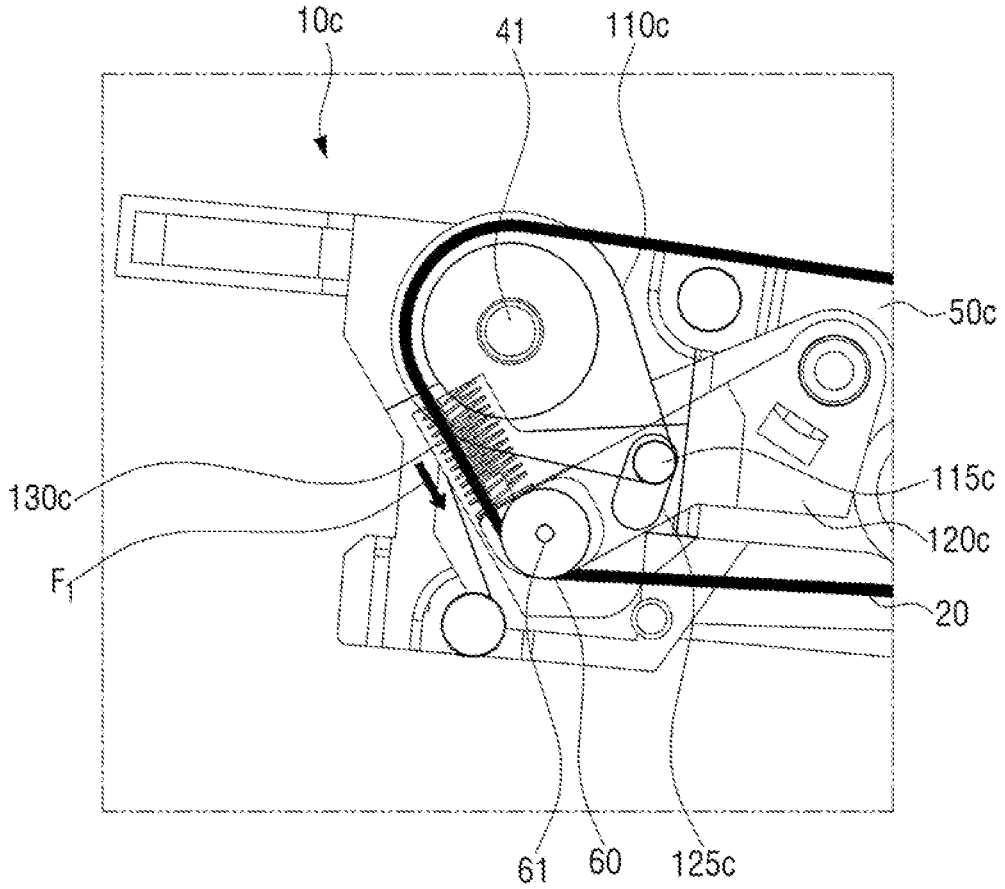
【Figure 13b】
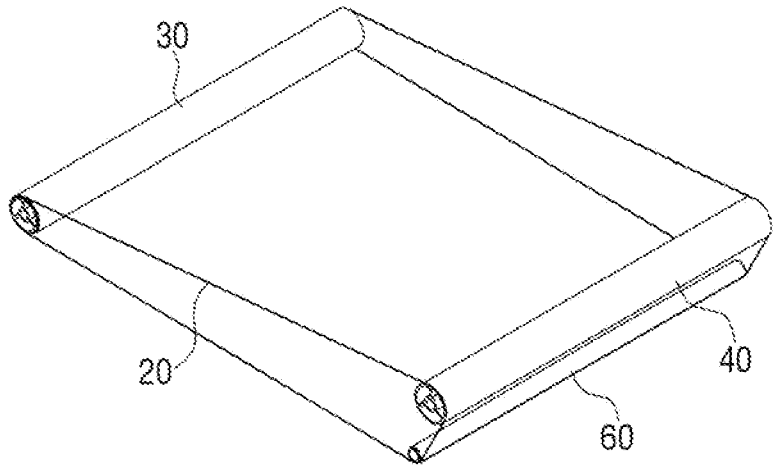

【Figure 14a】
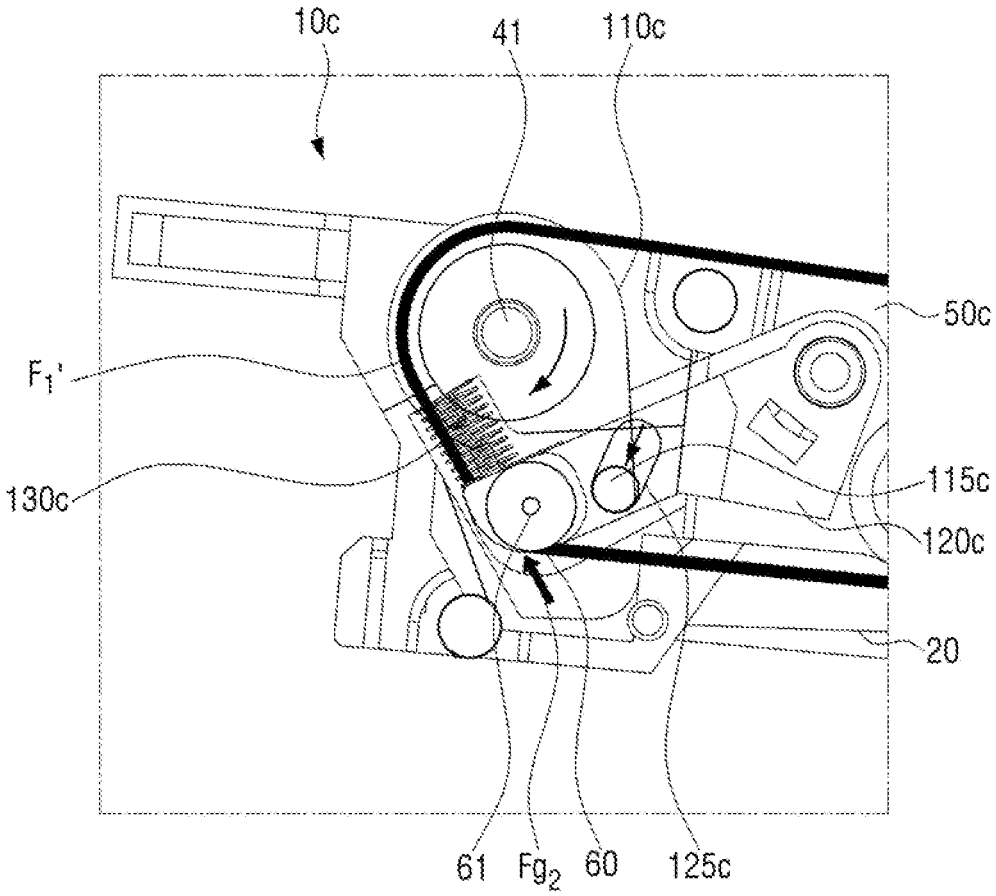
【Figure 14b】
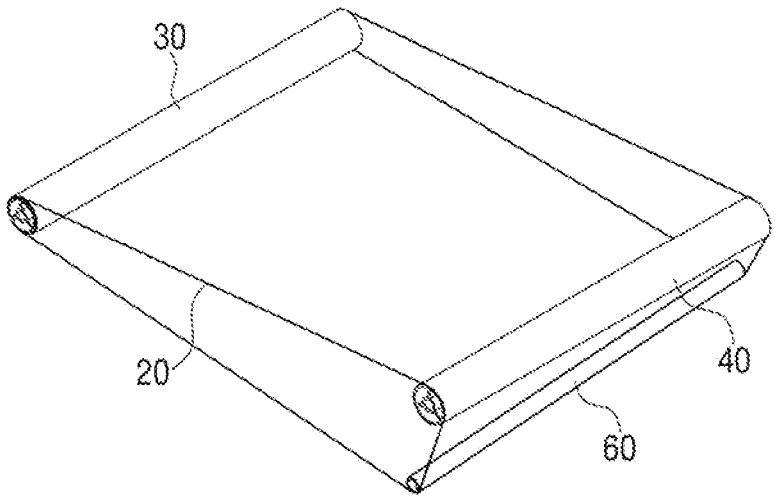

【Figure 15】
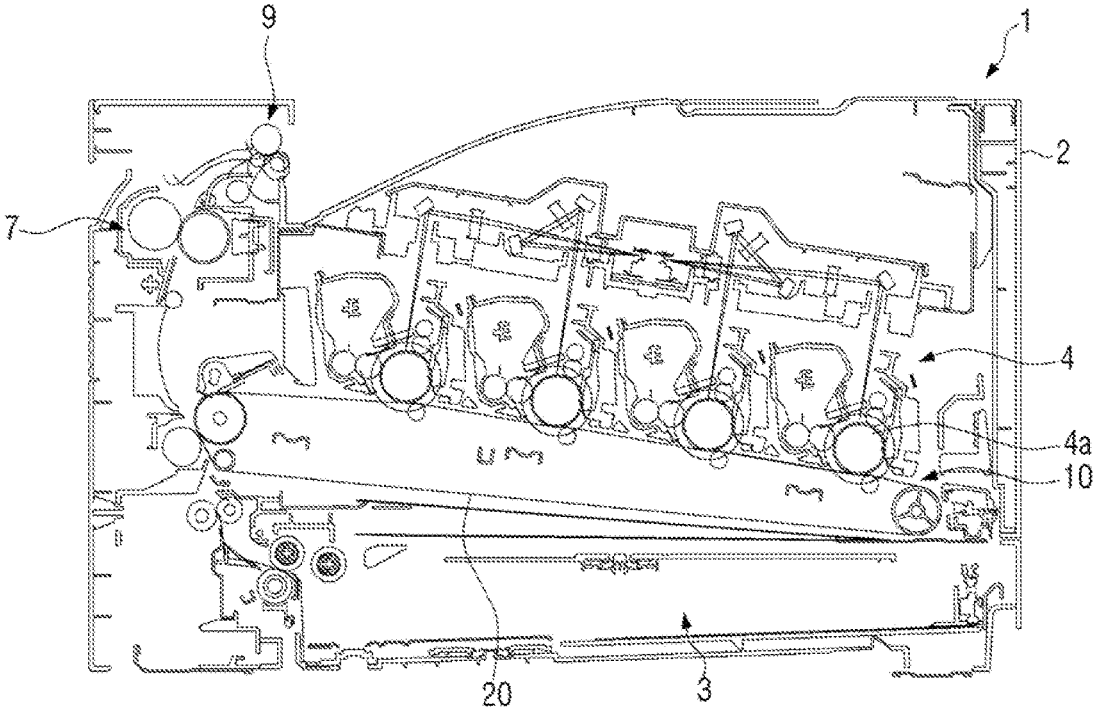

TRANSFER DEVICE HAVING MEANDERING PREVENTION MEMBERS FOR AN IMAGE FORMING APPARATUS

CROSS REFERENCE TO RELATED APPLICATIONS

This application is a continuation of U.S. patent application Ser. No. 16/312,932, filed on Dec. 21, 2018, which is a U.S. national stage of International Application No. PCT/KR 2017/002486 filed on Mar. 8, 2017, which claims the priority benefit of Korean Patent Application No. 10-2016-0080898 filed on Jun. 28, 2016. U.S. patent application Ser. No. 16/312,932, International Application No. PCT/KR 2017/002486, and Korean Patent Application No. 10-2016-0080898 are each incorporated by reference herein in their entirety.

BACKGROUND

In general, an image forming apparatuses refer to an apparatus which forms an image on a printing medium and include a printer, a copier, a facsimile, a multifunction peripheral (MFP) in which functions of the printer, the copier, and the facsimile are integrated into one apparatus, and the like.

Such an image forming apparatus transfers an image formed on a photosensitive medium to a printing medium using an intermediate transfer medium. For example, a transfer belt which travels in contact with the photosensitive medium is widely used as the intermediate transfer medium. The transfer belt receives images for colors from photosensitive mediums to overlap each other and obtains an image of color by overlap-transferring the images for the colors and a final overlapping image moves to a printing medium which moves in contact with the transfer belt. The transfer belt serves to move the overlap-transferred color image to the printing medium while the transfer belt travels to one direction in a state supported through a plurality of support rollers.

BRIEF DESCRIPTION OF THE DRAWINGS

FIG. 1 is a perspective view illustrating a transfer device according to an example of the present disclosure.

FIG. 2 is an exploded perspective view illustrating a transfer device according to an example of the present disclosure.

FIG. 3 is an enlarged perspective view illustrating an A portion of FIG. 1.

FIGS. 4A-4B are plan views explaining a meandering process of a transfer belt.

FIGS. 5A-5B and 6A-6B are views explaining an operation process of a transfer device according to an example of the present disclosure.

FIGS. 7A-7B and 8A-8B are views explaining an operation process of a transfer device according to another example of the present disclosure.

FIGS. 9A-9B and 10A-10B are views explaining an operation process of a transfer device according to further another example of the present disclosure.

FIG. 11 is an enlarged perspective view illustrating a movable member according to further another example of the present disclosure.

FIGS. 12A-12B, 13A-13B, and 14A-14B are views illustrating an operation process of a transfer device according to still another example of the present disclosure.

FIG. 15 is a cross-sectional diagram illustrating an image forming apparatus according to an example of the present disclosure.

DETAILED DESCRIPTION

When the transfer belt travels through the support rollers, the transfer belt may be biased to one side due to mechanical errors of the supporting rollers. When the transfer belt is biased to the one side, color mismatching and the crack or breakage of the transfer belt due to the cumulative fatigue by unevenness of the lateral tension of the transfer belt may be caused.

Hereinafter, examples of the present disclosure will be described in detail with reference to accompanying FIGS. 1 to 15. The examples described below will be described based on examples which are most suitable for understanding technical features of the present disclosure and the technical features of the present disclosure are not limited by the examples described below, but the present disclosure may be implemented like the examples described below.

Accordingly, the present disclosure may, however, be embodied and modified in many different forms and the modified examples should be pertained in the technical scope of the present disclosure. To help the understanding of the examples described below, in the drawings, the same reference numerals are denoted to the same elements.

FIG. 1 is a perspective view illustrating a transfer device according to an example of the present disclosure, FIG. 2 is an exploded perspective view illustrating a transfer device according to an example of the present disclosure, and FIG. 3 is an enlarged perspective view illustrating an A portion of FIG. 1.

Referring to FIGS. 1 to 3, a transfer device 10 according to an example of the present disclosure includes a frame 50, at least one pair of rollers 30 and 40, a transfer belt 20 which travels through support of the pair of rollers 30 and 40, and meandering prevention members 100 which prevent meandering of the transfer belt 20.

The transfer belt 20 receives an image of a photosensitive medium and transfers the image into a printing medium while traveling. At this time, any one roller of the pair of rollers 30 and 40 is a driving roller 30 which receives driving force from a driving source and the other roller is a backup roller 40 which supports the transfer belt 20 and rotates with the driving roller 30. Further, the transfer device 10 according to an example of the present disclosure may further include a tension roller 60 which is located at one side of the backup roller 40 and applies preset tension to the transfer belt 20.

The frame 50 rotatably supports both ends of the driving rollers 30 and the backup roller 40. The frame 50 may rotatably support a rotation shaft 31 of the driving roller 30 and a shaft 41 of the backup roller 40 and the transfer belt 20 may easily travel to one direction through the driving roller 30 and the backup roller 40.

Further, the transfer device 10 according to an example of the present disclosure may further include holders 120. One end portion of each holder 120 may be rotatably coupled to an outer surface of the frame 50 and the other portion of the holder 120 may rotatably support either end portion of the tension roller 60. The holder 120 may control the tension of the transfer belt 20 by varying a position of the tension roller 60 through the driving of the movable member 110 to be described later.

The meandering prevention member 100 may include a coupling ring 105 and the movable member 110. The coupling ring 105 is independently rotatably coupled to the rotation shaft 41 of the backup roller 40. The movable member 110 may be coupled to an outer side of the coupling ring 105 and rotate with the coupling ring 105.

For example, the coupling ring 105 may have a cylindrical shape having a hollow and the hollow of the coupling ring 105 is inserted into the rotation shaft 41. The coupling ring 105 may have an outer diameter smaller than that of the backup roller 40. The coupling ring 105 may have a predetermined width along a lengthwise direction of the rotation shaft 41 of the backup roller. Therefore, the coupling ring may rotate independently of the backup roller 40 without contact with an inner surface of the transfer belt 20.

The movable member 110 may have an outer diameter larger than that of the backup roller 40. That is, when the transfer belt 20 is meandered and one side of the transfer belt 20 is in contact with the movable member 110, the movable member 110 and the coupling ring 105 may be rotatably driven through friction force or frictional force with the transfer belt 20.

One-side portion of the movable member 110 may have a protruding shape to transfer a moment generated through contact with the transfer belt 20 to the transfer belt 20. For example, the movable member 110 may include a body 1101 having a cylindrical shape corresponding to the backup roller 40 and a wing 1102 having a shape protruding from the body 1101. The body 1101 may have an outer diameter larger than that of the backup roller 40 and when the transfer belt 20 is meandered, the body may prevent the transfer belt 20 from meandering to the outer side and the body may simultaneously rotate with transfer belt because of frictional force generated by its contact with the transfer belt 20.

One end portion of the wing 1102 may be coupled to the body 1101 and the other end portion of the wing 1102 may be of a shape with a reduced cross-section area. The wing 1102 may have straight line portions 1102*a* coupled to an outer circumferential surface of the body 1101 and a curved portion 1102*b* which couples the straight line portions 1102*a*. That is, when the movable member 110 rotates through the meandering of the transfer belt 20, a contact surface 1205 of the holder 120 to be described later may be easily pressed through the curved portion 1102*b* provided in the wing 1102.

The holders 120 may be provided in outer surfaces of the frame 50 and for example, receiving parts 51 formed to be recessed from the outer surfaces of the frame may be provided in both sides of the frame 50, and the holders 120 may be located to be received in the receiving part 51. A hole 1203 may be formed in one end portion of the holder 120 to be coupled to a rotation shaft 1201 provided in the frame 50 and the one end portion of the holder may be rotatably coupled to the frame 50.

The contact surface 1205 having a preset width may be provided in one surface (upper surface) of the holder 120 to be in contact with the movable member 110.

Further, the transfer device 10 according to an example of the present disclosure may further include an elastic member 130 installed between the holder 120 and the frame 50. The elastic member 130 may be fixedly installed between the holder 120 and the frame 50. For example, an elastic member fixing part 1208 configured to fix the elastic member 130 may be provided. The elastic member fixing parts 1208 may be located between the holder 120 and the receiving part 51 of the frame 50 and have a protruding shape to face each other.

The position of the elastic member 130 or the position of the elastic member fixing part 1208 is not limited thereto and may be modified through various examples to be described later.

The coupling ring 105, the movable member 110, the holder 120, and the elastic member 130 according to an example of the present disclosure may be located at either side of the backup roller 40. Hereinafter, it will be described on the basis of the coupling ring 105, the movable member 110, the holder 120, and the elastic member 130 located at one side and structures and operation processes of the coupling ring 105, the movable member 110, the holder 120, and the elastic member 130 located at the other side may be equally applied in the same manner as the coupling ring 105, the movable member 110, the holder 120, and the elastic member 130 located at the one side.

A process of varying the position of the holder 120 through the driving of the movable member 110 will be described in detail with reference to the following drawings.

FIGS. 4A-4B are plan views illustrating a meandering process of a transfer belt and FIGS. 5A-5B and 6A-6B are views explaining an operation process of a transfer device according to another example of the present disclosure.

FIGS. 4A, 5A, and 5B are diagrams illustrating a state before meandering generation of a transfer belt and FIGS. 4B, 6A, and 6B are diagrams illustrating a state after the meandering generation of the transfer belt.

First, referring to FIGS. 4A, 5A, and 5B, when the transfer belt 20 travels in a state spaced at a preset interval from the movable member 110, the movable member 110 may support the contact surface 1205 of the holder 120 with a preset force Fg1 and simultaneously the elastic member 130 may provide a preset elastic force F1 to the holder 120 and thus the tension roller 60 may maintain the tension of the transfer belt 20 with the preset force (Fg1+F1).

Referring to FIGS. 4B, 6A, and 6B, when the meandering of the transfer belt 20 is generated toward one side, one side of the transfer belt 20 is in contact with the movable member 110 and the movable member 110 rotates. The force generated through the rotation of the movable member 110 is applied to the holder 120. The tension roller 60 increases the tension of the transfer belt 20 by pressing the transfer belt 20 by the force Fg2 applied to the holder 120.

In this case, a difference between the forces applied to one side and the other side of the transfer belt 20 is smaller than a difference between the forces applied to the one side and the other side of the transfer belt 20 in the meandering state. That is, the difference of the tensions between both sides of the transfer belt 20 is reduced and finally, the meandering force applied to the transfer belt 20 may be reduced and the transfer belt 20 may return to a normal state.

FIGS. 7A-7B and 8A-8B are views explaining an operation process of a transfer device according to another example of the present disclosure. FIGS. 7A and 7B are diagrams illustrating a state before meandering generation of a transfer belt and FIGS. 8A and 8B are diagrams illustrating a state after meandering generation of the transfer belt. Hereinafter, the transfer device will be described on the basis of the difference from the transfer device according to an example of the present disclosure described with reference to FIGS. 1 to 6B and omitted description therefor may be replaced with the above-described description of the transfer belt.

First, referring to FIGS. 7A-7B, a transfer device 10*a* according to another example of the present disclosure may include a frame 50*a*, holders 120*a*, meandering prevention members 100*a*, and elastic members 130*a*. One end portion of the holder 120*a* may be rotatably coupled to the frame 50*a* and the tension roller 60 may be rotatably coupled to the other end portion of the holder 120*a*.

The meandering prevention member 100*a* includes a movable member 110*a* and a coupling ring 105*a*. When the transfer belt 20 is meandered, the movable member 110*a* may be driven through the contact (friction force) with the transfer belt 20 and control the tension of the transfer belt 20.

In the transfer device 10*a* according to another example of the present disclosure, the elastic member 130*a* may be installed between the movable member 110*a* and the holder 120*a*. For example, an installation surface 111*a* may be formed on a wing 1102*a* of the movable member 110*a* which faces a contact surface 1205*a* of the holder 120*a*. Elastic member fixing parts 1208*a* may be provided between the installation surface 111*a* and the contact surface 1205*a* of the holder 120*a* in a protruding shape such that they may to face each other so as to fasten the elastic member 130*a*.

That is, when the transfer belt 20 travels in a state spaced at a preset interval form the movable member 110*a*, the elastic member 130*a* may provide the preset elastic force F1 to the holder 120*a* and the tension roller 60 may maintain the preset tension of the transfer belt 20.

Referring to FIGS. 8A-8B, when the transfer belt 20 is meandered to one side, one side of the transfer belt 20 is in contact with the movable member 110*a*. The movable member 110*a* applies the force Fg1 generated through rotation in a contact state with the transfer belt 20 to the elastic member 130*a*. The force (F1+Fg1) applied to the elastic member 130*a* moves the tension roller 60 by pressing the holder 120 and the tension roller 60 increases the tension of the transfer belt 20.

FIGS. 9A-9B and 10A-10B are views explaining an operation process of a transfer device according to further another example of the present disclosure and FIG. 11 is an enlarged perspective view illustrating a movable member according to further another example of the present disclosure. FIGS. 9A and 9B are diagrams illustrating a state before meandering generation of a transfer belt and FIGS. 10A and 10B are diagrams illustrating a state after the meandering generation of the transfer belt. Hereinafter, the transfer device will be described on the basis of the difference from the transfer device according to an example of the present disclosure described with reference to FIGS. 1 to 6B and omitted description therefor may be replaced with the above-described description of the transfer device.

First, referring to FIGS. 9A-9B and 11, a transfer device 10*b* according to further another example of the present disclosure may include a frame 50*b*, holders 120*b*, meandering prevention members 100*b*, and elastic members 130*b*. One end portion of the holder 120*b* may be rotatably coupled to the frame 50*b* and the tension roller 60 may be rotatably coupled to the other end portion of the holder 120*b*. The meandering prevention member 100*b* includes a movable member 110*b* and a coupling ring 105*b*. When the transfer belt 20 is meandered, the movable member 110*b* may be driven by the contact (friction force) with the transfer belt 20 and directly control the tension of the transfer belt 20.

The movable member 110*b* may be coupled to the coupling ring 105*b* coupled to the rotation shaft 41 of the backup roller 40 and rotate independently of the backup roller 40. The movable member 110*b* may include a body 111*b* having a larger outer diameter than the coupling ring 105*b* and a wing 112*b* protruding from the body 111*b*. Further, the movable member 110*b* may further include an idle roller 1109*b* provided in the wing 112*b*. The idle roller 1109*b* may protrude toward the body 111*b* and rotate independently of the wing 112*b*. The idle roller 1109*b* may be located on the same plane as the transfer belt 20 to be in contact with the transfer belt 20 through the rotation of the body 111*b*.

The elastic member 130*b* may be fixedly installed between the holder 120*b* and the frame 50*b*. For example, elastic member fixing parts 1208*b* configured to fix the elastic member 130*b* may be provided. The elastic member fixing parts 1208*b* may have protruding shapes between the holder 120*b* and a receiving part 51*b* to face each other. The elastic member 130*b* may provide the elastic force F1 toward the holder 120*b* and the tension roller 60 may provide the preset tension to the transfer belt 20.

Referring to FIGS. 10A-10B, when the transfer belt 20 is meandered to one side, one side of the transfer belt 20 is in contact with the movable member 110*b*. As the movable member 110*b* is rotated in contact with the transfer belt 20, the idle roller 1109*b* rotates toward the transfer belt 20. Accordingly, the force Fg1 generated by the moment of the movable member 110*b* may be directly applied to the transfer belt 20 through the idle roller 1109*b* and the tension of the transfer belt 20 may be increased.

That is, the difference of the tensions between both sides of the transfer belt 20 may be reduced and finally, the meandering force applied to the transfer belt 20 may be reduced and the transfer belt 20 may return to the normal state.

FIGS. 12A-12B, 13A-13B, and 14A-14B are views illustrating an operation process of a transfer device according to still another example of the present disclosure. FIGS. 12A, 13A, and 13B are diagrams illustrating a state before meandering generation of the transfer device according to still another example of the present disclosure and FIGS. 12B, 14A, and 14B are diagrams illustrating a state after the meandering generation of the transfer device according to still another example of the present disclosure. Hereinafter, the transfer device will be described on the basis of the difference from the transfer device according to an example of the present disclosure described with reference to FIGS. 1 to 6B and omitted description therefor may be replaced with the above-described description of the transfer device.

First, referring to FIGS. 12A, 13A, and 13B, a transfer device 10*c* according to still another example of the present disclosure may include a frame 50*c*, holders 120*c*, meandering prevention members 100*c*, and elastic members 130*c*. One end portion of the holder 120*c* may be rotatably coupled to the frame 50*c* and the tension roller 60 may be rotatably coupled to the other end portion of the holder 120*c*.

The meandering prevention member 100*c* includes a movable member 110*c* and a coupling ring 105*c*. When the transfer belt 20 is meandered, the movable member 110*c* may be driven through the contact (friction force) with the transfer belt 20 and control the tension of the transfer belt 20.

A guide rail 21 protruding with a preset width in either inner side end portion of the transfer belt 20 may be formed in the transfer belt 20. The movable member 110*c* may be installed at either side of the backup roller 40 and rotate independently of the backup roller 40. The coupling ring 105*c* may be coupled to the rotation shaft 41 of the backup roller 40 and the movable member 110*c* may be located between the coupling ring 105 and the backup roller 40.

For example, the coupling ring 105*c* may have a smaller outer diameter than the backup roller 40 and may be provided not to interfere with an inner surface of the transfer belt 20. Further, the movable member 110*c* may have an outer diameter smaller than that of the backup roller 40 and larger than that of the coupling ring 105*c*. That is, before the meandering of the transfer belt 20 is generated, the guide rail 21 may not be in contact with the movable member 110*c* and the elastic member 130*c* applies the elastic force F1 to the holder 120*c* and the tension roller 60 applies the preset tension to the transfer belt 20.

A guide protrusion 115*c* may be formed to protrude in a tip portion of a wing in the movable member 110*c*. Further, a guide groove 125*c* into which the guide protrusion 115*c* is inserted may be formed in the holder 120*c*. That is, when the guide protrusion 115*c* is guided and moved along the guide groove 125*c*, the tension roller 60 may reduce the tension applied to the transfer belt 20.

Referring to FIGS. 12B, 14A, and 14B, the transfer device 10*c* according to still another example of the present disclosure is meandered, the guide rail 21 is in contact with the movable member 110*c* and the movable member 110*c* rotates through the friction force with the guide rail 21. The guide protrusion 115*c* moves along the guide groove 125*c* through the rotated force. That is, a force Fg2 generated through the rotation of the holder 120*c* reduces an elastic force F1' between the holder 120*c* and the frame 50*c* by pressing the elastic member 130*c* and the tension applied to the transfer belt 20 is reduced.

Accordingly, the difference between the tensions in both sides of the transfer belt 20 may be reduced and finally, the meandering force applied to the transfer belt 20 may be reduced and the transfer belt 20 may return to the normal state.

That is, the transfer devices 10, 10*a*, 10*b*, and 10*c* according to various examples of the present disclosure may improve the color image matching and product reliability by effectively preventing the meandering of the transfer belt 20 even with a simple structure. Further, the transfer devices prevent breakage of the transfer belt 20 due to unevenness of lateral tension of the transfer belt 20 in advance and increase lifespan of parts.

FIG. 15 is a cross-sectional diagram illustrating an image forming apparatus according to an example of the present disclosure. Referring to FIG. 15, an image forming apparatus 1 may include a main body 2 including an image forming member and the transfer device 10, 10*a*, 10*b*, and 10*c* according to the above-described various examples. A paper feeder 3 configured to receive a plurality of pieces of paper, a developing device 4, the transfer device 10, 10*a*, 10*b*, and 10*c*, a fixing device 7, and a paper discharger 9 may be installed at the main body 2.

When printing starts, the paper received in the paper feeder 3 may move to a developing device 4 side and the developing device 4 may form a visible image by transferring a developer to an electrostatic latent image formed in a surface of a photosensitive medium 4*a* according to image information.

The photosensitive medium 4*a* formed with the visible image transmits the visible image from a transfer nip formed in a contact position with the transfer device 10, 10*a*, 10*b*, and 10*c* according to various examples of the present disclosure to the transfer device 10, 10*a*, 10*b*, and 10*c*.

For example, the image forming apparatus 1 may be a color image forming apparatus. Since photosensitive mediums 4*a* for colors are separately installed, four color images are printed once when the transfer belt 20 rotates once and thus high-speed printing may be possible. The paper formed with the color image through the above-described process may receive heat and pressure from the fixing device 7, the color image is fixed to the paper surface, and the paper may discharge to the outside of the main body 2 through the paper discharger 9.

The image forming apparatus 1 according to an example of the present disclosure may be applied to various apparatuses having a function to print an image on a printing medium such as a copier, a printer, a facsimile, and a multifunction peripheral (MFP) in which functions of the copier, the printer, and the facsimile are integrated into one apparatus in addition to the color image apparatus.

Various examples of the present disclosure have separately described above, but the examples are not inevitably implemented in a single manner and the configuration and operation of each example may be implemented to be combined with at least another example.

The foregoing examples are merely example and are not to be construed as limiting. The description of the examples is intended to be illustrative, and not to limit the scope of the claims, and many modifications and variations will be apparent to those skilled in the art.

What is claimed is:

1. An image forming apparatus, comprising:

a main body including an image forming member; and a transfer device to transfer an image formed using the image forming member to a printing medium, the transfer device including:

a frame, a driving roller rotatably supported by the frame, a backup roller rotatably supported by the frame, a transfer belt to travel between the driving roller and the backup roller, the transfer belt including guide rails coupled to respective inner side end portions of the transfer belt, and meandering prevention members to rotate independently of the backup roller, the meandering prevention members including a first meandering prevention member located between a first end portion of the backup roller and the frame, and a second meandering prevention member located between a second end portion of the backup roller and the frame, and when the transfer belt meanders and contacts one of the first and second meandering prevention members, the one of the first and second meandering prevention members is to be rotatably driven to increase a tension of the transfer belt, and when the transfer belt meanders and one of the guide rails contacts one of the first and second meandering prevention members, the one of the first and second meandering prevention members is to be rotatably driven to decrease a tension of the transfer belt.

2. The image forming apparatus according to claim 1, wherein at least one of the meandering prevention members include:

a coupling ring coupled to a rotation shaft of the backup roller, and a movable member, coupled to the coupling ring, to rotate with the coupling ring, the movable member including one side portion having a protruding shape to transfer a moment generated through rotation of the movable member to the transfer belt.

3. The image forming apparatus according to claim 2, wherein the transfer device further includes:

a tension roller to be in contact with the transfer belt and to apply a preset tension to the transfer belt, and a holder including a first end portion rotatably coupled to the frame and a second end portion to support an end portion of the tension roller and to be in contact with the movable member to vary a position of the tension roller.

4. The image forming apparatus according to claim 3, wherein the transfer device further includes an elastic member, located between the frame and the holder, to provide an elastic force toward the tension roller.

5. The image forming apparatus according to claim 3, wherein the movable member includes:

a body having an outer diameter larger than an outer diameter of the coupling ring, and a wing, protruding in a shape having a cross-section area reduced toward an inner surface of the transfer belt from the body, to press the holder.

6. The image forming apparatus according to claim 5, wherein a first end portion of the wing is coupled to the body and a second end portion of the wing has the shape having the cross-section area reduced.

7. The image forming apparatus according to claim 5, wherein the wing has straight line portions coupled to the body and a curved portion which couples the straight portions and is to press the holder.

8. The image forming apparatus according to claim 3, wherein the transfer device further includes an elastic member, located between the holder and the movable member, to provide an elastic force toward the tension roller.

9. The image forming apparatus according to claim 8, wherein the movable member includes:

a body having an outer diameter larger than an outer diameter of the coupling ring, and a wing, protruding from the body, having an installation surface to which a first end of the elastic member is fixed, the installation surface of the wing facing a contact surface of the holder to which a second end of the elastic member is fixed.

10. The image forming apparatus according to claim 2, wherein the movable member includes:

a body having an outer diameter larger than an outer diameter of the coupling ring, a wing protruding from the body in a shape having a cross-section area reduced toward an inner surface of the transfer belt, and an idle roller, protruding toward the body from the wing, to be rotatable independently of the wing and to be in contact with the transfer belt through rotation of the body.

11. The image forming apparatus according to claim 1, wherein the guide rails include a first guide rail coupled to a first inner side end portion of the transfer belt and a second guide rail coupled to a second inner side end portion of the transfer belt, and when the transfer belt meanders and the first guide rail contacts one of the first and second meandering prevention members, the one of the first and second meandering prevention members is to be rotatably driven to decrease a tension of the transfer belt.

12. A transfer device, comprising:

a frame;

a first roller rotatably supported by the frame;

a second roller rotatably supported by the frame;

a transfer belt to travel between the first and second rollers, the transfer belt including guide rails coupled to respective inner side end portions of the transfer belt; and meandering prevention members to rotate independently of the first roller, the meandering prevention members including a first meandering prevention member located between a first end portion of the first roller and the frame, and a second meandering prevention member located between a second end portion of the first roller and the frame, and when the transfer belt meanders and contacts one of the first and second meandering prevention members, the one of the first and second meandering prevention members is to be rotatably driven to increase a tension of the transfer belt, and when the transfer belt meanders and one of the guide rails contacts one of the first and second meandering prevention members, the one of the first and second meandering prevention members is to be rotatably driven to decrease a tension of the transfer belt.

13. The transfer device according to claim 12, wherein at least one of the meandering prevention members include:

a coupling ring coupled to a rotation shaft of the first roller, and a movable member, coupled to the coupling ring, to rotate with the coupling ring, the movable member including one side portion having a protruding shape to transfer a moment generated through rotation of the movable member to the transfer belt.

14. An image forming apparatus, comprising:

a main body including an image forming member; and a transfer device to transfer an image formed using the image forming member to a printing medium, the transfer device including:

a frame, a driving roller rotatably supported by the frame, a backup roller rotatably supported by the frame, a transfer belt to travel between the driving roller and the backup roller, a tension roller to be in contact with the transfer belt and to apply a tension to the transfer belt, a holder including a first end portion rotatably coupled to the frame and a second end portion to support an end portion of the tension roller, and meandering prevention members to rotate independently of the backup roller, the meandering prevention members including a first meandering prevention member located between a first end portion of the backup roller and the frame, and a second meandering prevention member located between a second end portion of the backup roller and the frame, and when the transfer belt meanders and contacts one of the first and second meandering prevention members, the one of the first and second meandering prevention members is to be rotatably driven to increase a tension of the transfer belt, at least one of the meandering prevention members including:

a coupling ring coupled to a rotation shaft of the backup roller, and a movable member, coupled to the coupling ring, to rotate with the coupling ring, the movable member including one side portion having a protruding shape to transfer a moment generated through rotation of the movable member to the transfer belt, and to be in contact with the holder to cause a position of the tension roller to be varied.

15. The image forming apparatus according to claim 14, wherein the transfer device further includes an elastic member, located between the frame and the holder, to provide an elastic force toward the tension roller.

16. The image forming apparatus according to claim 14, wherein the movable member includes:

a body having an outer diameter larger than an outer diameter of the coupling ring, a wing, protruding in a shape having a cross-section area reduced toward an inner surface of the transfer belt from the body, to contact the holder, and the wing has straight line portions coupled to the body and a curved portion which couples the straight portions and is to contact the holder.

17. The image forming apparatus according to claim 16, wherein a first end portion of the wing is coupled to the body and a second end portion of the wing has the shape having the cross-section area reduced.

18. The image forming apparatus according to claim 14, wherein the transfer device further includes an elastic member, located between the holder and the movable member, to provide an elastic force toward the tension roller.

19. The image forming apparatus according to claim 18, wherein the movable member includes:

a body having an outer diameter larger than an outer diameter of the coupling ring, and a wing, protruding from the body, having an installation surface to which a first end of the elastic member is fixed, the installation surface of the wing facing a contact surface of the holder to which a second end of the elastic member is fixed.

20. The image forming apparatus according to claim 14, wherein the movable member includes:

a body having an outer diameter larger than an outer diameter of the coupling ring, a wing protruding from the body in a shape having a cross-section area reduced toward an inner surface of the transfer belt, and an idle roller, protruding toward the body from the wing, to be rotatable independently of the wing and to be in contact with the transfer belt through rotation of the body.

* * * * *